United States Patent [19]

Monge et al.

[11] Patent Number: 4,586,314

[45] Date of Patent: May 6, 1986

[54] FILLING METHOD AND APPARATUS

[75] Inventors: William A. Monge, St. Charles; Joseph M. Cerra, Orland Park, both of Ill.

[73] Assignee: Nestec S.A., Vevey, Switzerland

[21] Appl. No.: 666,618

[22] Filed: Oct. 30, 1984

[51] Int. Cl.[4] ..... B65B 5/06; B65B 35/30

[52] U.S. Cl. ..... 53/444; 53/149; 53/251; 53/258; 53/530; 53/544

[58] Field of Search ..... 53/148, 149, 251, 255, 53/258, 443, 444, 517, 530, 544; 198/434

[56] References Cited

U.S. PATENT DOCUMENTS

| | | | |
|---|---|---|---|
| 2,628,758 | 2/1953 | Gannon et al. | 53/517 X |
| 3,245,806 | 4/1966 | Miller | 53/530 X |
| 4,211,055 | 7/1980 | Long et al. | 53/517 |
| 4,386,490 | 6/1983 | Griffith et al. | 53/148 |

FOREIGN PATENT DOCUMENTS

| | | | |
|---|---|---|---|
| 528492 | 10/1940 | United Kingdom | 53/149 |

*Primary Examiner*—E. R. Kazenske
*Assistant Examiner*—Michael D. Folkerts
*Attorney, Agent, or Firm*—Vogt and O'Donnell

[57] ABSTRACT

A process for filling seven rod-shaped objects into a cylindrical container wherein a group of seven parallel rod-shaped objects supported in two adjacent rows of four and three respectively and having a substantially trapeziform configuration in cross-sectional outline, is forced lengthwise through a funnel whose internal wall defines a longitudinal fin and is suitably profiled to undergo a gradual transition in cross-sectional outline from roughly trapeziform at the inlet to roughly hexagonal at the outlet so as to guide longitudinally and rearrange the rod-shaped objects to have substantially the configuration in cross-sectional outline of a regular hexagon, the longitudinal fin positioned to contact, and shaped to guide the middle rod-shaped object of the row of three to the center of the hexagon while simultaneously the outer rod-shaped objects of the row of three are guided to form the adjacent corners of the hexagon on either side of the fin, the two inner rod-shaped objects of the row of four are guided to form the adjacent corners of the hexagon opposite the longitudinal fin and the two outer rod-shaped objects of the row of four are guided to form the remaining corners of the hexagon, in which configuration the group of rod-shaped objects is forced out of the funnel into the container.

23 Claims, 10 Drawing Figures

Figure 1:
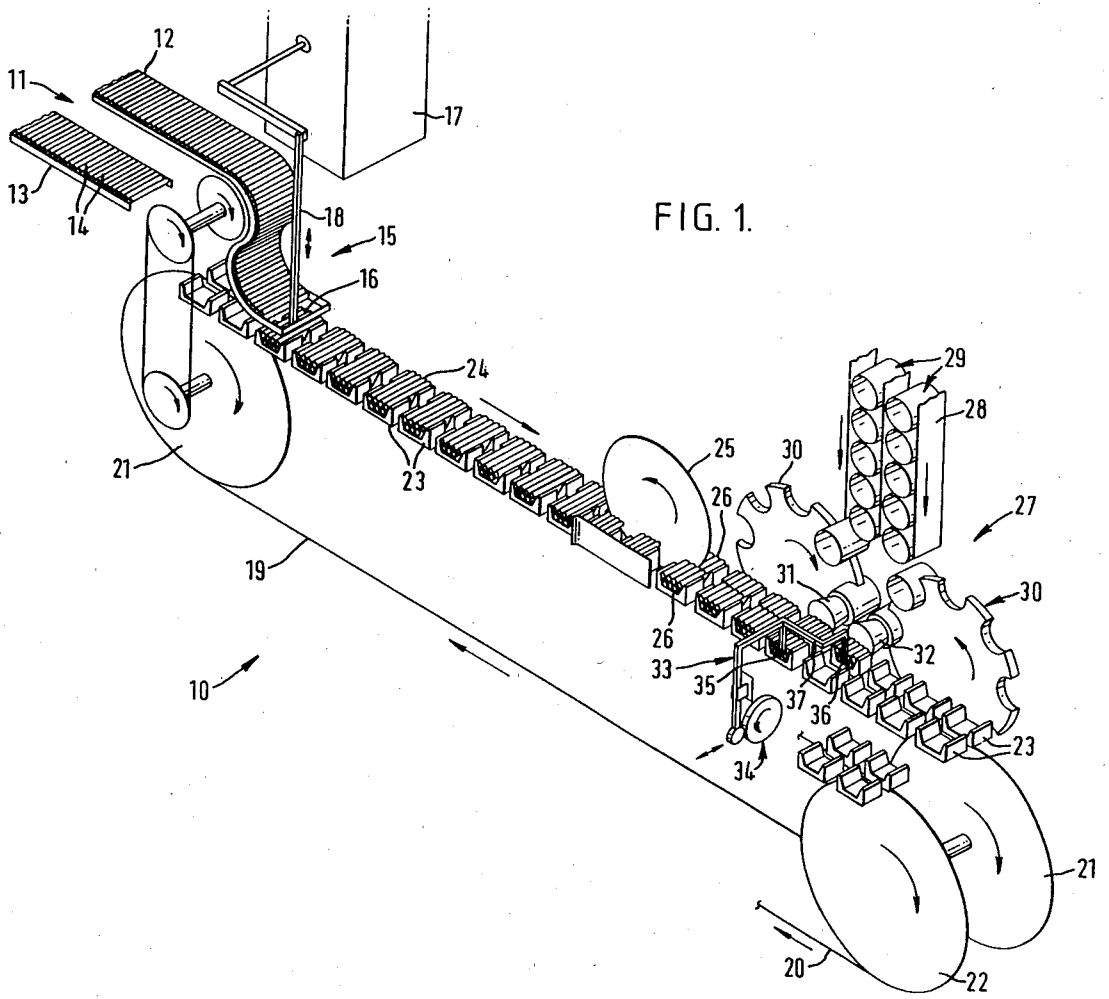

FIG. 4.
FIG 5.
FIG. 6.
FIG. 7.
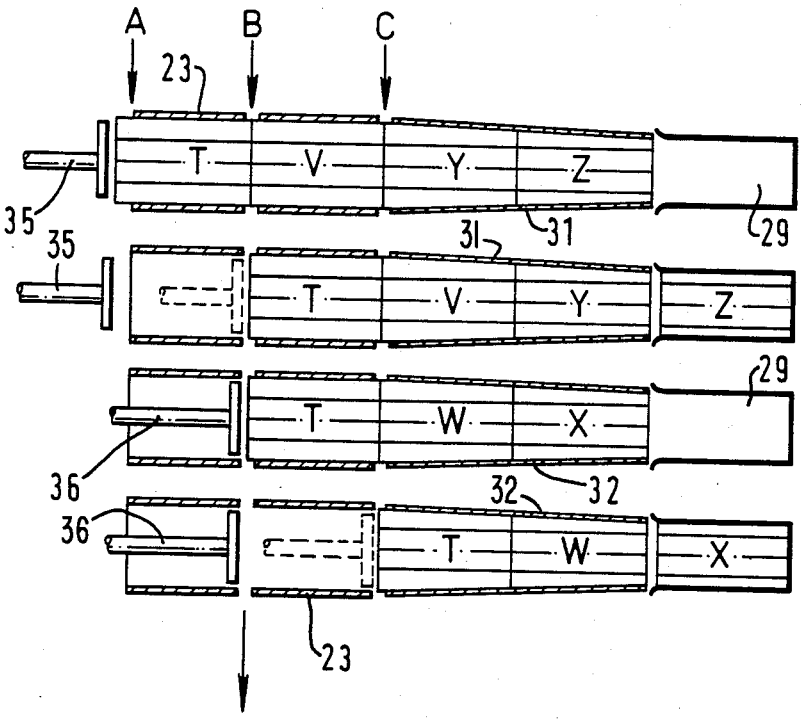
FIG. 8.
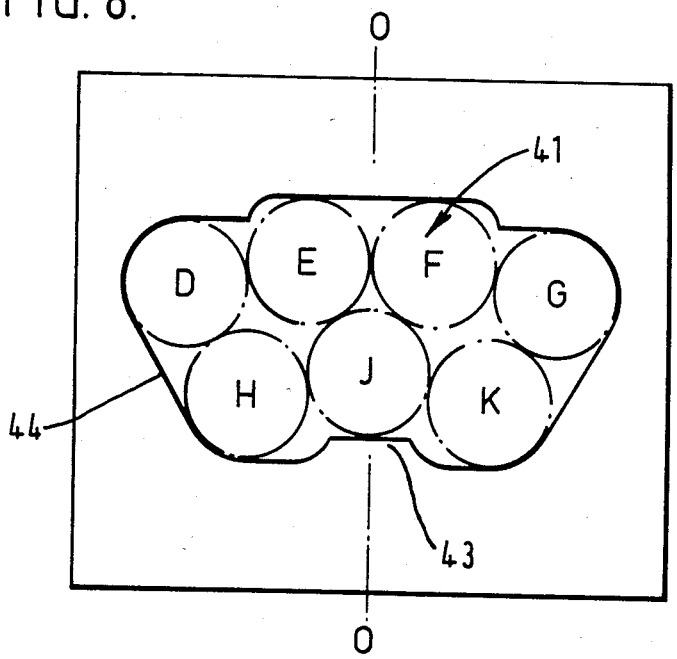

FILLING METHOD AND APPARATUS

The present invention relates to a method for filling rod-shaped objects into cylindrical containers.

In the canning of Vienna sausages, it is desirable to have a pack in which a cylindrical container is filled with seven parallel links arranged so that there is one link at the center surrounded by six links substantially equally spaced around the circumference: such an arrangement has substantially the configuration in cross-sectional outline of a regular hexagon with one link at the center and the remaining six links surrounding it, each at one corner of the hexagon. However, the task of arranging the sausage links in such a configuration presents numerous technical difficulties commercially which lead to substantial material losses and the need for extra labour to ensure correct filling.

We have now devised an ingenious method which is extremely effective in filling a cylindrical container with seven parallel rod-shaped objects arranged so that there is one rod-shaped object at the center surrounded by six rod-shaped objects substantially equally spaced around the circumference. Our method substantially overcomes the technical difficulties and can be carried out efficiently and automatically. In addition, the use of the method of the present invention makes it possible to carry out the complete process for the production of Vienna sausages automatically with significant savings in labour and materials when compared with the currently used process.

Accordingly, the present invention provides a process for filling seven rod-shaped objects into a cylindrical container wherein a group of seven parallel rod-shaped objects supported in two adjacent rows of four and three respectively and having a substantially trapeziform configuration in cross-sectional outline, is forced lengthwise through a funnel whose internal wall defines a longitudinal fin and is suitably profiled to undergo a gradual transition in cross-sectional outline from roughly trapeziform at the inlet to roughly hexagonal at the outlet so as to guide longitudinally and rearrange the rod-shaped objects to have substantially the configuration in cross-sectional outline of a regular hexagon, the longitudinal fin positioned to contact, and shaped to guide the middle rod-shaped object of the row of three to the center of the hexagon while simultaneously the outer rod-shaped objects of the row of three are guided to form the adjacent corners of the hexagon on either side of the fin, the two inner rod-shaped objects of the row of four are guided to form the adjacent corners of the hexagon opposite the longitudinal fin and the two outer rod-shaped objects of the row of four are guided to form the remaining corners of the hexagon, in which configuration the group of rod-shaped objects is forced out of the funnel into the container.

Thus, in the container, the seven parallel rod-shaped objects are arranged with one in the center surrounded by six substantially equally spaced around the circumference.

In the present invention, it is to be understood that the group of rod-shaped objects in adjacent rows of four and three respectively have the formation wherein each rod-shaped object of the row of three is positioned opposite and parallel to the junction line between two adjacent rod-shaped objects of the row of four. The general configuration in cross-sectional outline of this formation of a group of rod-shaped objects roughly conforms to the shape of an isosceles trapezium i.e. a quadrangle with two parallel sides of unequal length, the two remaining sides being of equal length each at the same acute angle to the longer parallel side. By "trapeziform" in this invention, we mean shaped like an isosceles trapezium.

The rod-shaped object preferably has a substantially circular or polygonal cross-section and should have sufficient resilience to maintain its general shape during the process: examples are candy sticks or sausages, especially Vienna sausages. The length of the rod-shaped object is not critical and may be from 2.5 to 30 cms, preferably from 5 to 15 cms for sausages.

The inlet of the funnel should roughly correspond in shape to the trapeziform cross-sectional outline of the group of rod-shaped objects and should be of a size at least as large as the said cross-sectional outline to permit entry of the group of rod-shaped objects while maintaining them at the point of entry substantially in their trapeziform configuration. Preferably, the inlet of the funnel is slightly larger than the cross-sectional outline of the rod-shaped objects.

The outlet of the funnel should roughly correspond in shape to the cross-sectional outline of the six rod-shaped objects at the corners of a regular hexagon and should be of a shape and size suitable to maintain the rod-shaped objects in a substantially hexagonal configuration, preferably slightly smaller than the mouth of the container into which the rod-shaped objects are filled.

The depth of the longitudinal fin defined by the profiled internal wall of the funnel conveniently increases gradually from the inlet end until the forward edge of the rod-shaped object which it guides reaches the center of the hexagon, after which it may decrease in depth or even terminate provided the said rod-shaped object is supported by the other rod-shaped objects.

The funnel may, if desired, be capable of holding more than one group of seven rod-shaped objects placed end to end, preferably two groups.

The funnel is preferably situated so that the rod-shaped objects travel substantially horizontally through it to the container.

The container is conveniently positioned so that its mouth is adjacent to the outlet of the funnel.

The group of rod-shaped objects in adjacent rows of four and three respectively is conveniently supported in position in a receptacle which lacks side walls bounding the ends of the rod-shaped objects in order to enable them to be forced lengthwise out of the receptacle to the funnel, for example by means of a pusher.

Once in the funnel, the rod-shaped articles are suitably forced through the funnel and into the container by means of a further group of rod-shaped objects, forced out of the receptacle.

Beneficially, the receptacle has an open top through which the rod-shaped objects are advantageously loaded. The group of rod-shaped objects are conveniently supported in the adjacent rows of four and three by means of appropriately shaped internal walls of the receptacle.

Preferably, the rod-shaped objects lie in two horizontal layers in the receptacles and most preferably with the layer of four lying above the layer of three.

There is also provided according to the present invention machine for filling seven rod-shaped objects into a cylindrical container comprising (a) means for supporting said rod-shaped objects in adjacent rows of four and three respectively and having a substantially trapeziform configuration in cross-sectional outline, said means lacking side walls bounding the ends of the rod-shaped articles, (b) a funnel, through which the rod-shaped articles may be forced from the supporting means into the container, whose internal wall defines a longitudinal fin and is suitably profiled to undergo a gradual transition in cross-sectional outline from roughly trapeziform at the inlet to roughly hexagonal at the outlet so as to guide longitudinally and rearrange the rod-shaped objects to have substantially the configuration in cross-sectional outline of a regular hexagon, the longitudinal fin positioned to contact, and shaped to guide the middle rod-shaped object of the row of three to the center of the hexagon while the profiled internal wall is adapted to simultaneously guide the outer rod-shaped objects of the row of three to form the adjacent corners of the hexagon on either side of the fin, the two inner rod-shaped objects of the row of four to form the adjacent corners of the hexagon opposite the longtitudinal fin and the two outer rod-shaped objects of the row of four to form the remaining corners of the hexgaon, (c) means for positioning the supported rod-shaped objects with their ends adjacent to the inlet of the funnel, (d) means for positioning the mouth of the container adjacent to the outlet of the funnel, and (e) means for forcing the rod-shaped objects through the funnel into the container.

Conveniently the process and the machine of the present invention are operated continuously whereby a plurality of groups of rod-shaped objects are loaded consecutively in adjacent rows of four and three respectively in receptacles and conveyed, preferably horizontally, with their longitudinal axes transverse to the direction of travel, to the funnel where they are filled into containers consecutively by being forced through the funnel, for instance by means of a reciprocating pusher. The receptacles conveniently travel on an endless conveyor belt to which they are preferably attached.

In the continuous operation of the process and machine, there are preferably provided means for loading the receptacles consecutively with the rod-shaped objects, means for feeding empty containers consecutively to the outlet of the funnel and means for transporting filled containers away, usually to a seamer.

The funnel and the receptacles may be made of materials suitable for use in the handling of foodstuffs such as stainless steel or other suitable metals, Teflon or Plexiglas clear plastic. The belt may be made of, for example, stainless steel.

Figure 2:
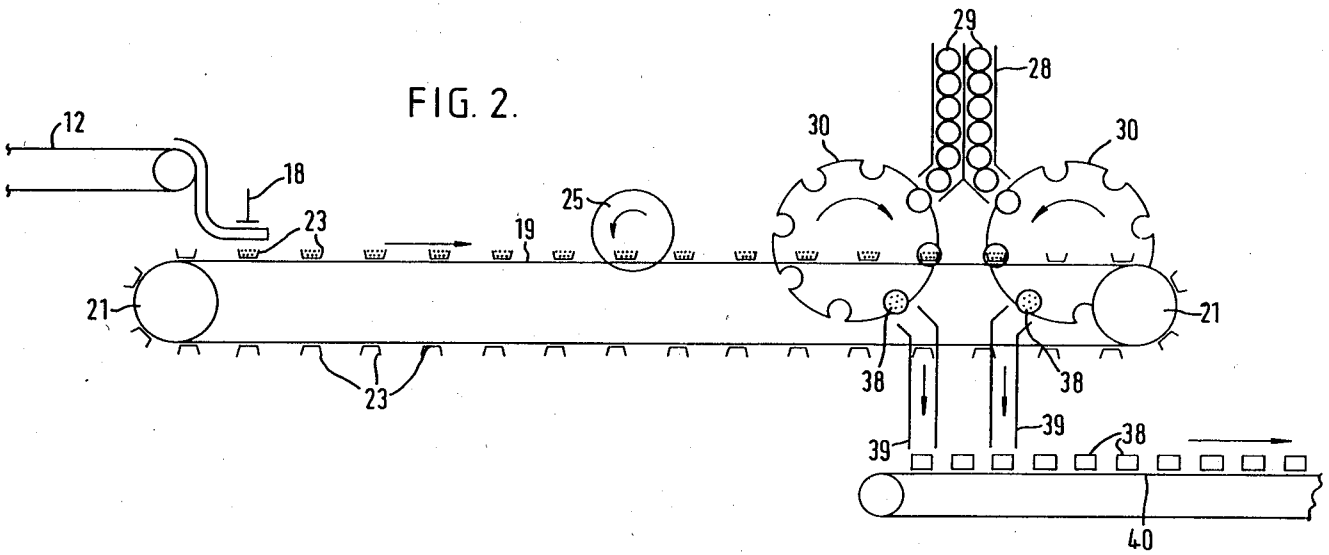
Figure 3:
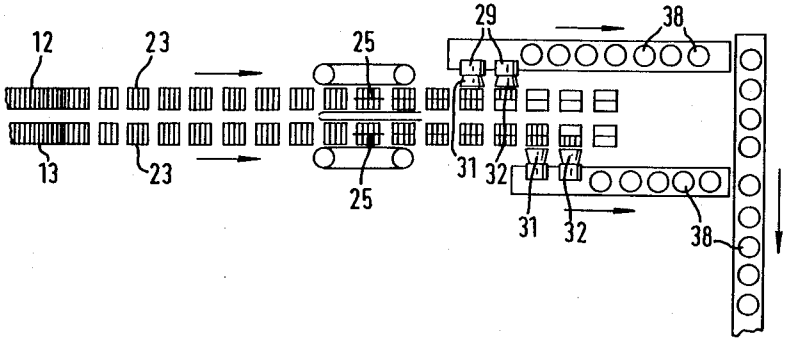
Figure 9:
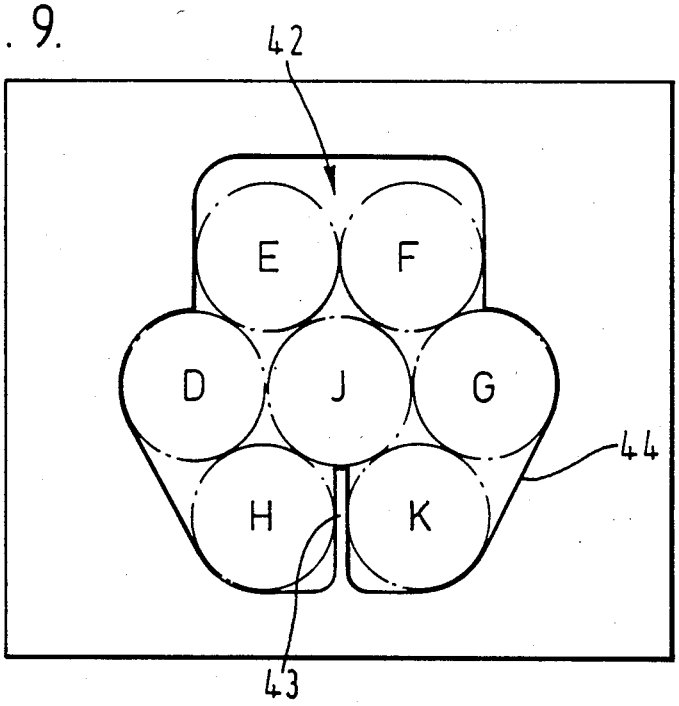
Figure 10:
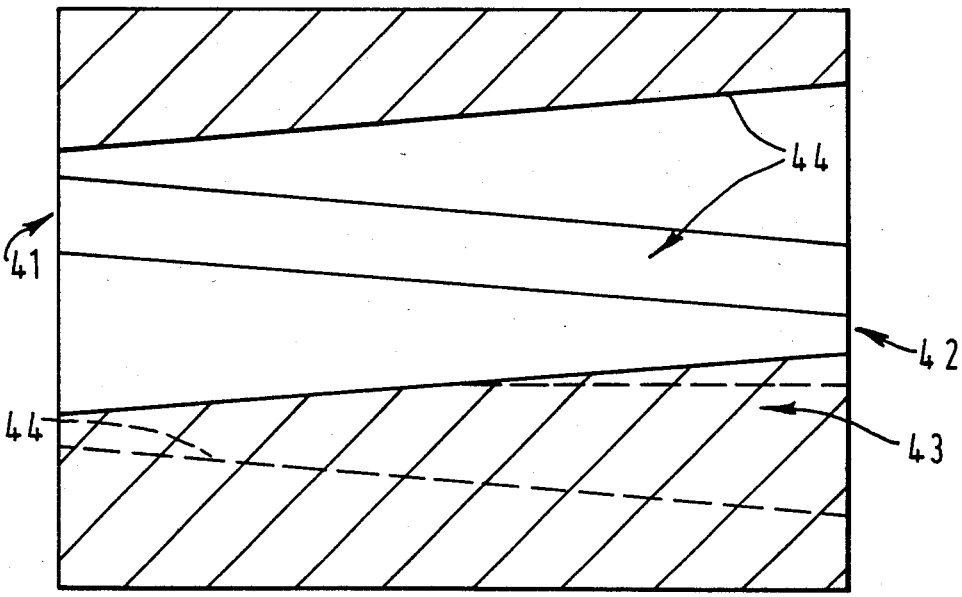

The present invention will now be illustrated by way of Example by reference to the following drawings in which FIG. 1 is a perspective diagrammatic view of the machine of the invention, FIG. 2 is a sectional side view of the same machine, FIG. 3 is a top plan view of the same machine, FIGS. 4 to 7 show the sausage loading sequence from on pair of trays into containers as a top plan view in which FIG. 4 shows the pair of trays filled with two groups of sausage links opposite the first funnel FIG. 5 shows the pair of trays still opposite the first funnel but with one group of sausage links discharged, FIG. 6 shows the pair of trays containing one group of sausage links opposite the second funnel and FIG. 7 shows the pair of trays still opposite the second funnel but emptied of the sausage links, FIGS. 8 to 10 show the passage of the sausage links through a funnel in which FIG. 8 shows the inlet end of the funnel, FIG. 9 shows the outlet end of the funnel, and FIG. 10 is a sectional side view through the centre of the funnel along the line 0—0 in FIG. 8.

A machine generally designated 10 is provided with a Warrick loader 11 manufactured by the Planet Products Corporation, Cincinnati, Ohio, USA, (only the loading part of which is shown) which comprises two conveyor belts 12, 13 carrying sausage links 14 of 4.5 inches (11.4 cms) length aligned side by side, a loading station 15 having an opening 16, an actuator 17 and a pusher 18. Fixed to two parallel endless stainless steel chains 19, 20 trained about pairs of rollers 21, 22 respectively (for convenience only chain 19 is shown in FIGS. 1 and 2) are a plurality of open-sided trays 23. The trays are arranged side by side in pairs along each chain and each pair is loaded with one group of seven sausage links 24 from the Warrick loader. A circular cutting knife 25 is provided for splitting the group of seven sausage links 24 into two groups 26 of length 2.25 inches (5.72 cms) each. A canning station generally designated 27 comprises an empty can feed 28 containing empty cans 29, twin can indexing turrets 30, two funnels 31, 32, can loading assembly 33 with loading cam 34, pushers 35, 36, connected by an arm 37. The filled cans 38 fall through a conduit 30 on to a conveyor belt 40 where they are transported to a seamer. Each funnel 31, 32 has a roughly trapeziform inlet 41, a roughly hexagonal shaped outlet 42 and a longitudinal fin 43, and a profiled internal wall 44 which undergoes a gradual transition in cross-sectional outline from roughly trapeziform to roughly hexagonal.

In operation, coagulated Vienna sausage strands 28 inches (71 cms) long are cut automatically into links 4.5 inches (11.4 cms) long, the end cuts which contain 4.1% sausage material being collected separately. The cut links 14 are then transported to the Warrick Loader 11 where they are aligned side by side in a straight row on conveyor belts 12, 13 from which they are loaded into pairs of open-sided trays 23 at the loading station 15 through the opening 16 by means of the pusher 18 controlled by the actuator 17 to lie in two layers with a lower layer of three links and an upper layer of four links.

The pairs of open-sided trays 23 are transported intermittently on endless stainless steel chains 19, 20 respectively, firstly to the circular cutting knife 25 which cuts the group of sausage links 24 transversely into two groups 26 of equal length, and then to the canning station 27 where two funnels 31, 32, each containing two groups of seven links placed end to end, are positioned. Twin can indexing turrets 30 convey two empty cans 29 to a position where their mouths lie adjacent the outlets 42 of the funnels, the chain stops and the can loading assembly 33 operated by a loading cam 34 causes each of pushers 35 and 36 simultaneously to force one group of sausage links respectively into the funnels 31, 32.

The sausage loading sequence into the containers is depicted in FIGS. 4 to 7 where one pair of trays 23 containing two groups of sausage links T, V, is conveyed to the canning station 27 and FIG. 4 shows the position where the pair of trays stops opposite loading funnel 31 containing two groups of sausage links Y, Z, adjacent to the outlet of which is empty can 29. Then, as shown in FIG. 5, while the trays are stationary, pusher 35 moves from position A to position B (shown by the dotted line) and causes groups T, V to push groups Y, Z a distance of 2.25 inches (5.72 cms) so that group Z is discharged into the can, after which the pusher returns to position A. The pair of trays 23 containing one group of sausages T in the right hand tray shown in FIG. 5 is then conveyed to the position shown in FIG. 6 where it stops opposite loading funnel 32 containing two groups of sausage links W, X, adjacent to the outlet of which is another empty can 20. Then, as shown in FIG. 7, while the trays are stationary, pusher 36 moves from position B to position C (shown by the dotted line) and causes group T to push groups W, X a distance of 2.25 inches (5.72 cms) so that group X is discharged into the can, after which the pusher returns to position B. Afterwards the empty tray 23 is conveyed back to the Warrick loader for reloading.

As can be seen, the pair of trays opposite funnel 31 contains two groups of sausage links 26 while the pair of trays opposite funnel 32 only contains one group of sausage links, one of the pairs having been discharged into funnel 31 during its previous stop.

The intermittent movements are synchronised so that while the chains 19, 20 are stationary the cam operated pushers force the sausage links into the cans and simultaneously further trays 23 are loaded with sausage links. During the period of movement of the chains 19, 20 the can turrets index one station to feed empty cans 29 to positions adjacent to the outlets of the funnels and filled cans 38 are transported away by falling through a conduit 39 on to a belt 40 where they are conveyed to a seamer.

In the continuous process, pusher 36 moves simultaneously with pusher 35 because they are connected by an arm 37 operated by the same loading cam 34 and since there are always two pairs of trays 23, one opposite each funnel, at the canning station 27 it can be seen that two cans are filled simultaneously from the trays on chain 19. This is duplicated on chain 20 so that four cans are filled simultaneously on the machine.

The passage of the sausage links 14 through the funnels 31, 32 is illustrated in FIGS. 8 to 10. The sausage links 26 pushed out of the tray enter the inlet 41 of the funnel with configuration of a layer of four D, E, F, G above a layer of three H, J, K. As they traverse the funnel, link J rides upon, and is guided by, longitudinal fin 43 to the center of the roughly hexagonal shaped outlet 42, while simultaneously the profiled internal wall 44 guides links H and K to drop down, one on either side of the longitudinal fin, links D and G to a position where one is on either side of center link J and links E and F to a position above and one on each side of center link J. This is the position of the links at the outlet of the funnel shown in FIG. 10 where it can be seen that links D, E, F, G, H and K are situated at the corners of a regular hexagon with link J in the center.

By this method it is possible to fill 240 cans per minute.

We claim:

1. A process for filling rod-shaped objects into a cylindrical container comprising:

(a) supporting a group of seven parallel rod-shaped objects in two adjacent rows having a substantially trapeziform configuration in cross-sectional outline, one row having four objects and one row having three, (b) rearranging the group of objects into a substantially hexagonal configuration by forcing the group of objects into and through a funnel, the funnel having a gradual transition in internal cross-sectional outline from substantially trapeziform at the inlet, to substantially hexagonal at the outlet, and guiding, within the funnel, the middle object of the row of three to a central position parallel to the other rod-shaped objects such that the outer objects of the row of three and the objects of the row of four are rearranged and are substantially equally spaced surrounding the circumference of the middle object in the central position, the rearranged objects defining in cross-sectional outline a substantially hexagonal configuration, and (c) forcing the rearranged group of seven objects from the funnel outlet into the container.

2. A process according to claim 1 wherein the rod-shaped objects are sausages.

3. A process according to claim 1 wherein the substantially trapeziform cross-sectional outline of the inlet of the funnel is slightly larger than the trapeziform cross-sectional outline of the group of rod-shaped objects in adjacent rows of four and three.

4. A process according to claim 1 wherein the outlet of the funnel is of a size suitable to maintain the rod-shaped objects in a substantially hexagonal configuration in cross-sectional outline.

5. A process according to claim 1 wherein the outlet of the funnel is slightly smaller than the mouth of the container into which the rod-shaped objects are filled.

6. A process according to claim 1 wherein the middle rod-shaped object of the group of three is guided by a longitudinal fin positioned on the internal wall of the funnel and profiled to increase gradually in depth, within the funnel from the inlet end toward the outlet end, to a depth capable of supporting the forward edge of the middle rod-shaped object which it guides in the center of the cross-sectional outline of the hexagon.

7. A process according to claim 1 wherein the funnel is positioned so that the rod-shaped objects travel substantially horizontally through it to the container.

8. A process according to claim 1 wherein the group of rod-shaped objects in adjacent rows of four and three is supported in position in a receptacle which lacks side walls bounding the ends of the rod-shaped objects.

9. A process according to claim 8 wherein the receptacle has an open top through which the rod-shaped objects are loaded.

10. A process according to claim 8 wherein the internal walls of the receptacle are shaped to support the adjacent rows of four and three rod-shaped objects.

11. A process according to claim 8 wherein the rod-shaped objects lie in two horizontal layers in the receptacle.

12. A process according to claim 8 wherein the rod-shaped objects lie in two horizontal layers in the receptacle with the layer of four lying above the layer of three.

13. A process according to claim 1 further comprising conveying a plurality of the receptacles in an endless manner and consecutively loading the receptacles with the rod-shaped objects in adjacent rows of four and three, conveying the receptacles to the funnel with the objects having their longitudinal axes transverse to the direction of travel, and forcing each group of objects through the funnel to load containers consecutively and reloading the receptacles and transporting the filled containers away.

14. A process according to claim 13 wherein the receptacles are conveyed horizontally on an endless conveyor belt.

15. A process according to claim 13, wherein the plurality of receptacles are aligned in side-by-side pairs and transported intermittently on endless conveying means to two adjacent funnels for loading into two containers simultaneously.

16. A machine for filling seven rod-shaped objects into a cylindrical container comprising:

(a) means for supporting said rod-shaped objects in adjacent rows of four and three respectively in a substantially trapeziform configuration in cross-sectional outline, said means lacking side walls bounding the ends of the rod-shaped objects, (b) a funnel, having an internal longitudinal fin, wherein the funnel is profiled to undergo a gradual transition in cross-sectional outline from substantially trapeziform at the inlet to substantially hexagonal at the outlet, and the longitudinal fin is positioned to contact and shaped to guide the middle rod-shaped object of the row of three to the center of the hexagon and is profiled to increase gradually in depth from the inlet end to a depth capable of supporting the middle rod-shaped object in the center of the cross-sectional outline of the hexagon, (c) means for positioning the supported rod-shaped objects with their ends adjacent to the inlet of the funnel, (d) means for positioning the mouth of a container adjacent to the outlet of the funnel, and (e) means for forcing the rod-shaped objects through the funnel into the container.

17. A machine according to claim 16 further comprising:

(a) a plurality of receptacles for supporting the rod-shaped objects, (b) means for loading the receptacles consecutively with the rod-shaped objects, (c) means for transporting the loaded receptacles, positioned so that the rod-shaped objects have their longitudinal axes transverse to the direction of travel, to the funnel, (d) means for feeding empty containers consecutively to the outlet of the funnel, and (e) means for transporting the filled containers away.

18. The machine of claim 16 wherein the fin of the funnel decreases in depth after rising to the depth capable of supporting one of the rod-shaped objects in the center of the cross-sectional outline of the hexagon.

19. The machine of claim 16 wherein the fin of the funnel terminates after rising to the depth capable of supporting one of the rod-shaped objects in the center of the cross-sectional outline of the hexagon.

20. A funnel, for rearranging seven rod-shaped objects in a trapeziform configuration into a hexagonal configuration for loading in cylindrical containers, comprising an interior wall profiled in cross-sectional outline to gradually transform from substantially trapeziform at the inlet to substantially hexagonal at the outlet and having a longitudinal fin profiled along the interior wall to increase gradually in depth from the inlet end to a depth capable of supporting one of the rod-shaped objects in the center of the cross-sectional outline of the hexagon.

21. The funnel of claim 20 wherein the substantially trapeziform and hexagonal cross-sectional outlines of the inlet and outlet of the funnel correspond in shape to trapeziform and hexagonal cross-sectional outlines of the rod-shaped objects.

22. The funnel of claim 20 wherein the fin decreases in depth after rising to the depth capable of supporting one of the rod-shaped objects in the center of the cross-sectional outline of the hexagon.

23. The funnel of claim 20 wherein the fin terminates after rising to the depth capable of supporting one of the rod-shaped objects in the center of the cross-sectional outline of the hexagon.

* * * * *

UNITED STATES PATENT AND TRADEMARK OFFICE

CERTIFICATE OF CORRECTION

PATENT NO. : 4,586,314

DATED : May 6, 1986

INVENTOR(S) : William A. Monge, et al.

It is certified that error appears in the above—identified patent and that said Letters Patent is hereby corrected as shown below:

Column 4, line 30, "30" should read -- 39 --.

Column 5, line 11, "20" should read -- 29 --.

Signed and Sealed this

*Fifth* Day of *August 1986*

[SEAL]

*Attest:*

*Attesting Officer*

DONALD J. QUIGG

*Commissioner of Patents and Trademarks*